US007628314B2

(12) United States Patent
Huth et al.

(10) Patent No.: US 7,628,314 B2
(45) Date of Patent: Dec. 8, 2009

(54) GABLE TOP CONTAINER WITH PERFORATED OPENING ARRANGEMENT

(75) Inventors: Russell H. R. Huth, Castle Rock, CO (US); James F. Orsillo, Woburn, MA (US); W. Andrew Elmes, Glen Allen, VA (US); John A. Latham, Asheville, NC (US)

(73) Assignee: BRPP, LLC, Canton, NC (US)

( * ) Notice: Subject to any disclaimer, the term of this patent is extended or adjusted under 35 U.S.C. 154(b) by 162 days.

(21) Appl. No.: 11/495,105

(22) Filed: Jul. 28, 2006

(65) Prior Publication Data

US 2008/0023534 A1 Jan. 31, 2008

(51) Int. Cl.
*B65D 17/28* (2006.01)
*B65D 5/74* (2006.01)

(52) U.S. Cl. ..... 229/216; 229/125.42; 229/137

(58) Field of Classification Search ..... 229/121, 229/137, 125.42, 216, 237, 240, 241, 242
See application file for complete search history.

(56) References Cited

U.S. PATENT DOCUMENTS 2,750,101 A * 6/1956 Jacke ..... 229/235
3,869,078 A * 3/1975 Braun ..... 229/216
4,093,115 A * 6/1978 Bachner et al. ..... 229/216
4,314,642 A * 2/1982 Dagostine ..... 229/125.42
5,326,024 A * 7/1994 Fogle ..... 229/125.42
6,073,833 A * 6/2000 Desrosiers et al. ..... 229/242

FOREIGN PATENT DOCUMENTS

GB 2174979 * 11/1986

* cited by examiner

*Primary Examiner*—Gary E Elkins
(74) *Attorney, Agent, or Firm*—J. Bennett Mullinax, LLC

(57) ABSTRACT

A gable top container for storing an item is provided. The gable top container has a bottom made from at least one bottom forming panel. A side is formed from at least one side forming panel that extends from the bottom. A pair of gusset panels and a pair of gable panels extend from the side. The gable panels are arranged with respect to the gusset panels to form a gable top. Each of the gable panels has a fin that defines perforations that allow for the removal of at least a portion of the fin in order to effect opening of the container from one end of the gable panels to an opposite end of the gable panels. The container may be opened in order for a fork or spoon to be used in order to remove contents therefrom.

23 Claims, 4 Drawing Sheets

GABLE TOP CONTAINER WITH PERFORATED OPENING ARRANGEMENT

FIELD OF THE INVENTION

The present invention relates generally to containers that have a gabled top. More particularly, the present application involves a gable top container with a perforated opening arrangement that allows for the entire end of the container to be opened for accessing, adding to, or removing contents of the container.

BACKGROUND

Gable top containers are used for packaging food items such as milk, juice, syrup and candy. These types of containers are prepared from paperboard and are configured so that the top of the container forms a pair of gables on either end. The sides and bottom of the container are usually rectangular in shape. Portions of the container forming the gable are arranged so that a user can pull a section of the container apart and press onto a pair of wing portions to form a spout from which contents inside of the container may be poured or otherwise removed. Gable top containers of the type described are commonly used in schools for the packaging of milk.

A gable top container is manufactured by providing a paperboard blank of a suitable shape with a plurality of score lines thereon. The blank is bent along the score lines into a non-planar shape. The inner and outer surfaces of the paperboard making up a gable top container are provided with a thermoplastic coating such as polyethylene. Heat and pressure may be used in order to create a side seam of the gable top container. Additionally, heat and pressure can be employed to close the bottom and likewise the top of the gable top container once it is filled with a desired substance.

A user generally uses his or her thumbs to tear apart the ends of a pair of fins located above a V-shaped section of the gable top container. This action causes a pair of wings to be formed which are in turn pushed towards one another by the user in order to form a spout from which contents of the container may be removed. The remaining section of the fins continues to be adhered together so that roughly half of the end of the gable top container is opened and the other half is closed. Although such an arrangement is suitable for pouring contents from the gable top container, this arrangement may not be desirable for one to access the contents of the container with a utensil such as a spoon or fork. For example, if soup were contained in the gable top container a user may have difficulty in maneuvering a spoon through the single spout and removing soup therefrom due to the size and orientation of the spout.

If a user desires to completely open the gable top container he or she must open the closed half by again tearing apart the pair of fins of the closed half and pushing the subsequently formed wings together. As gable top containers are designed for only one opening, the process of opening the other half of the end may be difficult and can result in tearing of the paperboard of the container. It is therefore the case that current gable top containers are not configured to facilitate opening of the entire top of the gable top container in an easy manner. As such, there remains room for variation and improvement within the art.

SUMMARY

Various features and advantages of the invention will be set forth in part in the following description, or may be obvious from the description, or may be learned from practice of the invention.

The present invention provides for a gable top container for use in storing items such as food. The gable top container may include a pair of gusset panels and a pair of gable panels. The gable panels may include perforations that allow a user of the container to remove a portion of the gable panel therefrom. The container may then open to allow access through the entire end of the container. As the entire end of the container is opened, a user of the container may more easily be allowed to remove product in the container with the use of a fork or spoon.

In accordance with one exemplary embodiment of the present invention, a gable top container is provided that has a bottom made from at least one bottom forming panel. A side is included and is made from at least one side forming panel that extends from the bottom. A pair of gusset panels and a pair of gable panels extend from the side. The gable panels are arranged with respect to the gusset panels to form a gable top. Each of the gable panels has a fin that defines perforations to allow for the removal of at least a portion of the fin in order to effect opening of the container from one end of the gable panels to an opposite end of the gable panels.

Another exemplary embodiment resides in a gable top container as immediately discussed in which the perforations of the fins are located between an upper portion of the fins and a lower portion of the fins. The upper portion of the fins is configured to be removed in order to effect opening of the container.

The present invention also provides for a gable top container as immediately discussed in which the lower portions of the fins are defined by the perforations of the fins and score lines of the gable panels. The perforations are arranged in a parallel configuration to the score lines of the gable panels.

The present invention also provides for a gable top container as discussed above in which the upper portions, but not the lower portions, of the fins are adhered to one another.

Another exemplary embodiment of the present invention exists in a gable top container as discussed above in which the perforations have a plurality of tabs and apertures. Here, the length of the apertures is twice the length of the tabs.

A further exemplary embodiment resides in a gable top container as discussed above in which the gable panels have a score line from which the fins extend. The perforations are located less than the midpoint of the distance from the score lines to the edge of the fins.

Another exemplary embodiment is provided in a gable top container as previously discussed in which the perforations of the fins are located at the lower edge of the fins.

An additional exemplary embodiment of the present invention exists in a gable top container that has a bottom formed by first, second, third and fourth bottom forming panels. A side is present and is formed by first, second, third and fourth side forming panels that extend from the bottom. A side seam extends from the fourth bottom forming panel and the fourth side forming panel. The side seam is attached to the first side forming panel and the first bottom forming panel. A pair of gusset panels and a pair of gable panels extend from the side. The gable panels are arranged with respect to the gusset panels to form a gable top. Each of the gable panels define perforations that allow for the removal of at least a portion of the gable panels in order to effect opening of the container so that the gable panels separate from one another along their length in order to cause an end of the container to be opened.

An additional embodiment exists in a gable top container as immediately discussed in which each of the gable panels has a fin that extends from a score line of the gable panel to an edge of the gable panel. Perforations are present and are defined by the fins of the gable panels.

Yet another exemplary embodiment resides in a gable top container as immediately discussed in which upper portions of the fins are configured to be removed. Removal of the upper portions causes the container to be opened so that the gable panels separate from one another along their length.

A further exemplary embodiment of the present invention exists in a gable top container as described above in which the bottom defines a perimeter. The gusset panels and the gable panels are configured to open so that the edges of the gusset panels and the tops of the gable panels define a perimeter of the same size as the perimeter of the bottom.

Also provided for in accordance with the present invention is a gable top container as previously described in which the perforations have a plurality of tabs and apertures in which the length of the apertures is twice the length of the tabs.

Another embodiment exists in a gable top container as described above in which the gable panels and one of the gusset panels is configured for being opened to form a spout. An additional embodiment exists as immediately discussed in which the gable panels and the other one of the gusset panel are configured for being opened to form a spout.

A further exemplary embodiment of gable top container is present as discussed above in which each of the gable panels has a fin that extends from the perforations of the gable panels to an edge of the gable panels.

The present invention also provides for a gable top container that includes a bottom formed by first, second, third and fourth bottom forming panels. A side is present and is formed by first, second, third and fourth side forming panels that extend from the bottom. A side seam extends from the fourth side forming panel and is attached to the first side forming panel. A pair of gusset panels and a pair of gable panels extend from the side. The gable panels are arranged with respect to the gusset panels to form a gable top. The gable panels have fins that extend from score lines of the gable panels to edges of the gable panels. Upper portions of the fins are adhered to one another. The fins define perforations parallel to the score lines that allow for the removal of upper portions of the fins in order to effect opening of the container so that the gable panels separate from one another along their length in order to cause an end of the container to be opened.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
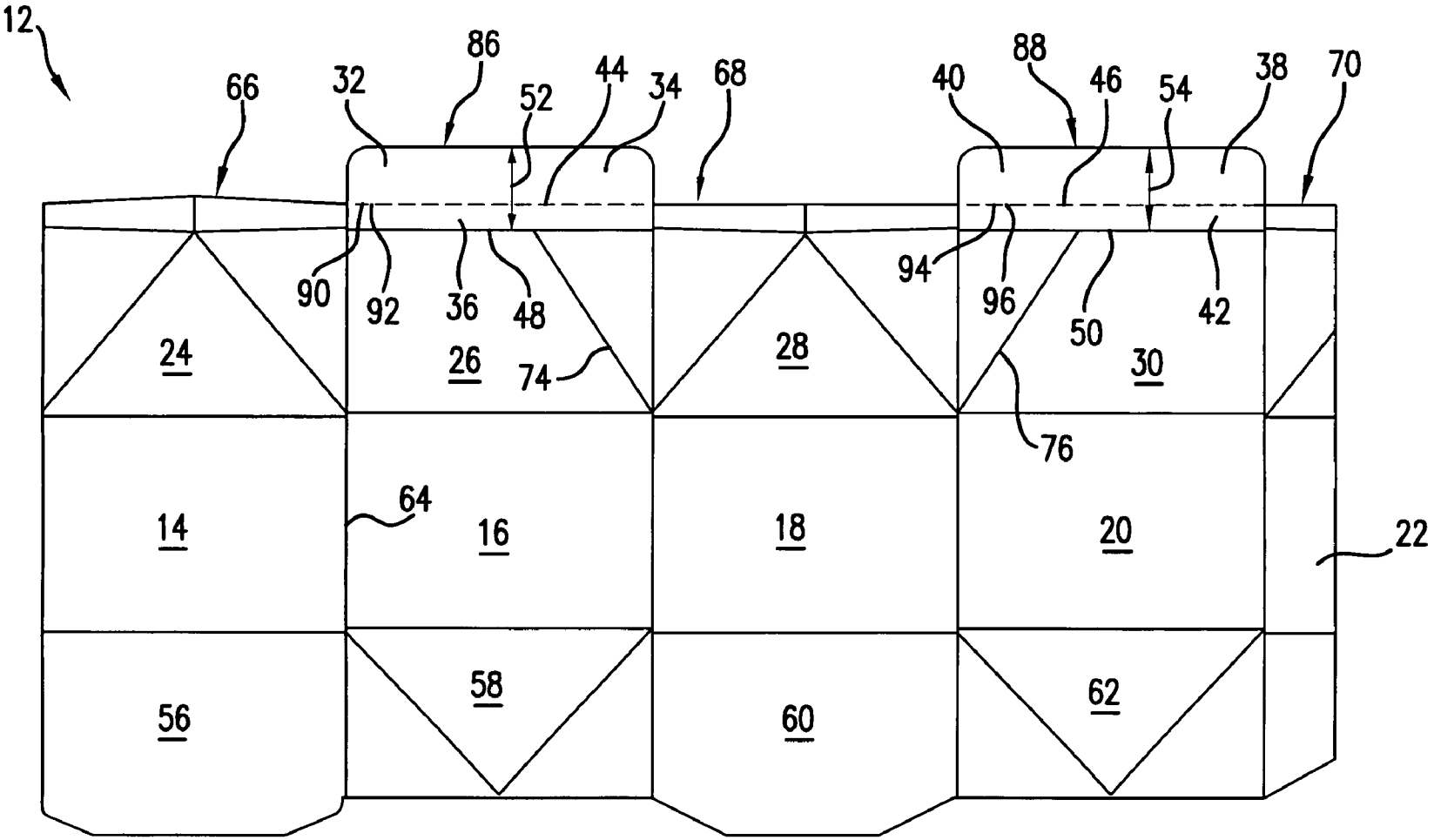
FIG. 1 is a plan view of a unitary blank that is used to form a gable top container in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a gable top container 10 with a pair of fins 32 and 38 at the top of the container 10 that include perforations 44 and 46. A user of the container 10 may tear the fins 32 and 38 along the perforations 44 and 46 in order to remove upper portions 34 and 40 of the fins 32 and 38. The perforated opening arrangement allows access through the entire end of the container 10. The interior of the container 10 can be accessed to allow a user to remove contents with the use of a fork or spoon. The perforated opening arrangement is configured in such a manner that the end of the container 10 may be opened relatively quickly with little effort and tearing of the paperboard that makes up the container 10.

FIG. 1 shows a paperboard blank 12 that can be used to form the container 10 in accordance with one exemplary embodiment of the present invention. The paperboard making up the blank 12 is generally rendered liquid impervious through application of a thermoplastic material such as polyethylene. The thermoplastic material is typically applied to both the front and back of the blank 12. The use of a thermoplastic coating may also achieve other benefits by preventing the entry or exit of odors or oxygen. Additionally, the thermoplastic coating may serve as a mechanism with which to seal the container 10 through heat and pressure during formation. The blank 12 is provided with a number of score lines such as the one represented by score line 64. The blank 12 can be folded along the score lines into the shape of a container 10 as shown in FIG. 2 and held into the desired shape through the geometry of the folds along with the sealing of various portions of the container 10 through the application of heat and pressure.

Figure 2:
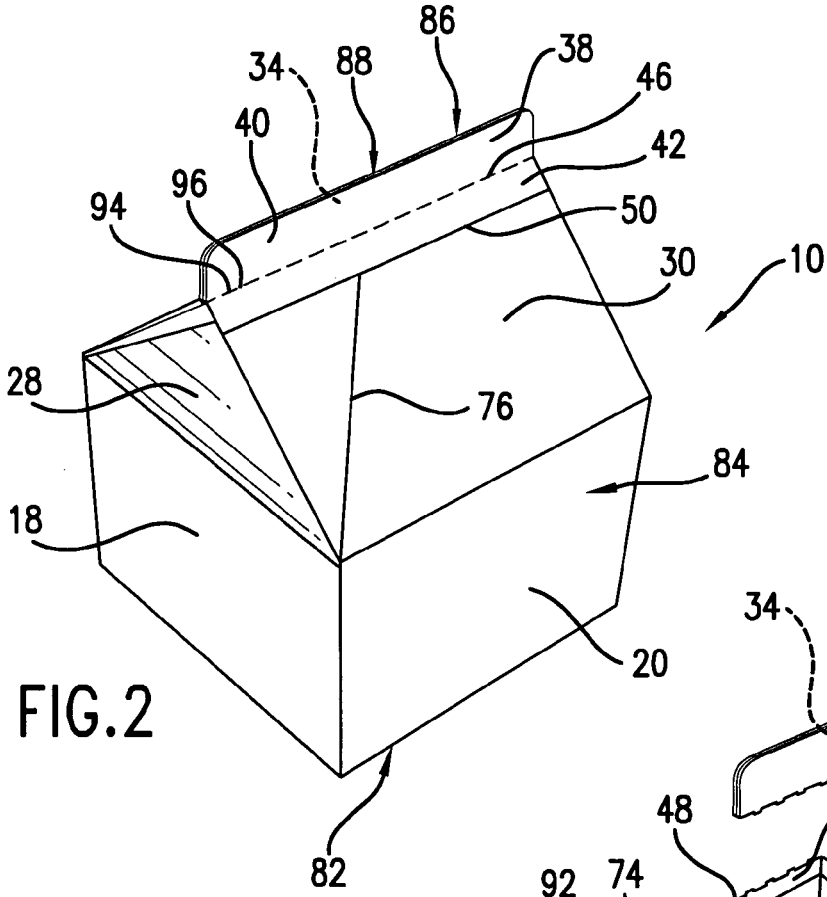
FIG. 2 is a perspective view of the gable top container formed by the blank of FIG. 1 in the closed position.

Referring to FIGS. 1 and 2, the blank 12 includes a plurality of side forming panels 14, 16, 18 and 20 that make up the side 84 of the container 10 when formed. A plurality of bottom forming panels 56, 58, 60 and 62 are present to likewise form the bottom 82 of container 10. The formation of the side 84 and bottom 82 of the container 10 from the various panels mentioned is commonly known in the art. Briefly, a side seam 22 is provided and is located adjacent the side forming panel 20 and bottom forming panel 62. The side seam 22 may be adhered to the side forming panel 14 and the bottom forming panel 56 during formation of the container 10. The blank 12 can be bent along various score lines so that the bottom forming panels 56, 58, 60 and 62 are folded into the bottom 82 of the container 10. The panels 56, 58, 60 and 62 lock into one another and form a bottom 82 that is multi-layered at certain locations. Heat and pressure may be applied to the panels 56, 58, 60 and 62 and side seam 22 to securely form the bottom 82 and sides 84 of the container 10. In one embodiment, heat is applied to the thermoplastic coating of the paperboard at various strategic locations that are designated as adhesion points. Next, the blank 12 is bent into the shape of container 10 and a sealing pressure is applied to the heated points in order to fuse the thermoplastic material to form a liquid impervious seal and effect closure of the bottom 82 and side 84 of the container 10. It is to be understood that the disclosed arrangement of forming the bottom 82 and side 84 of the container 10 is exemplary and that other designs are possible in accordance with other embodiments of the present invention.

The first side forming panel 14 is attached to a gusset panel 24. The gusset panel 24 includes a plurality of score lines that allow the gusset panel 24 to be folded in a desired configuration during formation of the container 10. The gusset panel 24 forms an end of the top of the container 10 and is inwardly disposed into an inverted V shape. Another gusset panel 28 is also included and is attached to the third side forming panel 18. Gusset panel 28 likewise has a plurality of score lines formed thereon that allow the gusset panel 28 to be bent in a desired manner to form an end of the top of the container 10 that is both inverted and V-shaped. The gusset panels 24 and 28 may be designed in any manner commonly known in the construction of gable top containers 10. For example, the gusset panels 24 and 28 may be provided as those shown in U.S. Pat. No. 4,813,546, the entire contents of which are incorporated by reference herein in their entirety for all purposes.

A gable panel 26 is located between gusset panels 24 and 28. The top of the gable panel 26 has a fin 32. The fin 32 defines perforations 44 that in turn demarcate an upper portion 34 of the fin 32 and a lower portion 36 of fin 32. Fin 32 has a height 52 that is measured from a score line 48 to an edge 86 of fin 32. The perforations 44 extend substantially in a linear direction parallel to score line 48. The perforations 44 may be located any distance from the score line 48. In one embodiment, the perforations 44 are located at the midpoint of the height 52 of fin 32. Alternatively, the perforations 44 may be located on fin 32 so as to be disposed at one third of the height 52 of fin 32 so that the upper portion 34 has twice the height of the lower portion 36. In a further embodiment, the perforations 44 are located at the same height of the fin 32 as an upper edge 66 of the gusset panel 24 and an upper edge 68 of the gusset panel 28. In this regard, the upper edges 66 and 68 contact opposite sides of the fin 32, and the perforations 44 are located in the height 52 direction of the fin 32 at the same point as the contact points of the upper edges 66 and 68 to fin 32. In still other embodiments, the perforations 44 may be located from one fourth to three fourths the distance of height 52 from the score line 48. In yet other embodiments, the perforations 44 may be located anywhere up to seven eighths the height 52 of fin 32 from score line 48.

Gable panel 30 also includes a fin 38 that defines perforations 46. Perforations 46 separate an upper portion 40 of fin 38 from a lower portion 42 of fin 38. Perforations 46 extend in a substantially linear orientation parallel to a score line 50 that designates the bottom of fin 38. Fin 38 has a height 54 that extends from score line 50 to an edge 88 of the fin 38. Perforations 46 may be located at any point in the height 54 direction of fin 38. For example, perforations 46 may be located one half or one third of height 54 from score line 50. Further, perforations 46 may be located with respect to the upper edge 68 of the gusset panel 28 and to an upper edge 70 of side seam 22. In this regard, perforations 46 may be located at the same point in the height 54 direction as the contact points of upper edges 68 and 70 to fin 38. In other embodiments, the perforations 46 may be located from one fourth to three fourths the distance of height 54 from the score line 50. In yet other embodiments, the perforations 46 may be located anywhere up to seven eighths the height 54 of fin 38 from score line 50. Gusset panel 24, gusset panel 28, gable panel 26 and gable panel 30 along with a portion of the side seam 22 remain as part of the side 84 of container 10 until after filling the container 10 with product. At such time, these components are then formed into the top of container 10.

In order to construct the container 10, the upper portions of the side seam 22 can be adhered to the gusset panel 24. The side seam 22 may be adhered, for instance, through the use of heat and pressure. The bottom 82 and side 84 of the container 10 may then be formed. Various top score lines may then be pre-bent. The side 84 and the top of the container 10 may be in a square or rectangular shape and the container 10 may be filled with product. Once the container 10 is filled with product, the gable top of the container 10 may be constructed by folding the gusset panels 24 and 28 in addition to the gable panels 26 and 30 along the various score lines into the structure shown in FIG. 2. The perforations 44 and 46 may be located at the apex of the inverted V shaped portion of the gable top formed by gable panels 26 and 30 in some embodiments or above the apex in other embodiments.

The fins 32 and 38 can be adhered to one another in order to seal and close the top of container 10. In this regard, heat and pressure may be applied to the upper portions 34 and 40 of fins 32 and 38 so that the upper portions 34 and 40 are adhered to one another while the lower portions 36 and 42 are not adhered. The bond strength between upper portions 34 and 40 is selected in order to create a strong enough seal to keep the top of the container 10 closed and to prevent product within the container 10 from escaping. The container 10 may be constructed in order to be of any volumetric capacity. For example, the container 10 may be an eight ounce carton in accordance with one embodiment. In accordance with other exemplary embodiments, the container 10 may be from a four to a sixteen ounce container 10, a thirty two ounce container 10, a sixty four ounce container 10, a four ounce to a one hundred twenty eight ounce container 10, or a gallon container 10.

Figure 3:
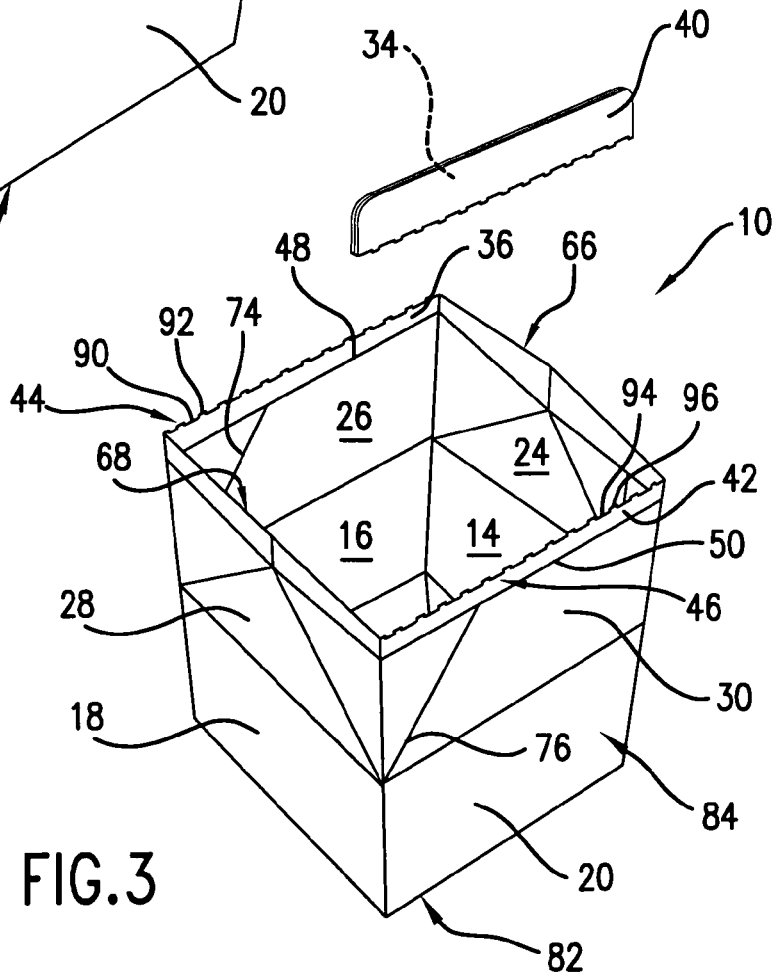
FIG. 3 is a perspective view of the gable top container formed by the blank of FIG. 1 in an open position in which the entire end of the gable top container is opened.

A user of the container 10 may grasp the upper portions 34 and 40 and pull in order to tear the fins 32 and 38 at the perforations 44 and 46. Removal of upper portions 34 and 40 results in opening of the container 10 as shown in FIG. 3. Here, the lower portions 36 and 42 of fins 32 and 38 are not adhered to one another and therefore separate after tearing of perforations 44 and 46. Likewise, the gusset panels 24 and 28 are not adhered to one another or to the gable panels 26 and 30 and separate upon removal of the upper portions 34 and 40. In this regard, the gable panels 26 and 30 may separate completely from one another along their length. The gable panels 26 and 30 may therefore open along their length. The top of the container 10 may then be further unfolded, if necessary, to completely open the top of the container 10 as shown in FIG. 3. In such a configuration, the entire end of the container 10 is opened to allow access therein. The upper edges 66 and 68 of the gusset panels 24 and 28 are generally aligned with the top of the lower portions 36 and 42 of fins 32 and 38 so as to form a container 10 with a substantially even top rim. However, it is to be understood that in other embodiments that the top of the lower portions 36 and 42 may be above or below the upper edges 66 and 68. The container 10 may be opened so that the perimeter formed by the upper edges 66 and 68 and the tops of lower portions 36 and 42 define a perimeter that is the same size as the perimeter defined by the bottom 82.

Opening of the entire end of the container 10 allows the user to have sufficient space to remove contents of the container 10 with a fork or spoon. Such a configuration may be advantageous when the container 10 is used for holding food items such as soup that require a utensil for removal. Alternatively, the container 10 may be used for holding dehydrated potatoes or other food items. Here, the user may tear off the upper portions 34 and 40 in order to open the container 10. Water may be added and the contents may be heated in a microwave. Subsequently, the opening of the container 10 is sufficiently large to allow a user to remove contents with the use of a fork or spoon. The container 10 could be used for holding a variety of dry, granular or palletized products.

The perforations 44 may include apertures 90 that extend completely through the paperboard making up the container 10 along with any thermoplastic coating that may be present on either side of the paperboard. Perforations 46 can also include apertures 94 that are provided in a similar manner to apertures 90. Alternatively, apertures 90 and 94 of the perforations 44 and 46 may extend through only a portion of the paperboard or through only the thermoplastic coating in other embodiments. The perforations 44 and 46 can be designed in a variety of manners in order to achieve fins 32 and 38 that require various amounts of force to be applied thereon in order to separate the upper portions 34 and 40 from the lower portions 36 and 42. In certain embodiments, the apertures 90 and 94 may be as deep as 75% to 80% of the thickness of the paperboard. Here, the thermoplastic coating may remain in tact in order to provide barrier properties and prevent contamination.

In accordance with one embodiment, tabs 92 of perforations 44 and tabs 96 of perforations 46 may have a length that is twice that of the apertures 90 and 94 intermediate the tabs 92 and 96. For instance, the apertures 90 and 94 of perforations 44 and 46 may have a length of $1/8^{th}$ inch and the tabs 92 and 96 of perforations 44 and 46 may have a length of $1/16^{th}$ inch in one embodiment. In other embodiments, apertures 90 and 94 may have a length of $1/8^{th}$ inch and tabs 92 and 96 may have a length of $1/32^{nd}$. In other embodiments the lengths of both the tabs 92 and 96 and the lengths of apertures 90 and 94 of perforations 44 and 46 may be the same. For example, both the apertures 90 and 94 and tabs 92 and 96 of perforations 44 and 46 may have a length of $1/32^{nd}$ inch. The perforations 44 and 46 may be arranged with respect to one another so that upon formation of container 10 the apertures 90 of perforations 44 align with the apertures 94 of perforations 46. Alternatively, the perforations 44 and 46 can be arranged so that their apertures 90 and 94 do not align but instead overlap with the tabs 92 and 96. Although described as being elongated and substantially parallel to score lines 48 and 50, the perforations 44 and 46 can be variously configured in other embodiments. For example, the perforations 44 and 46 may be elongated and disposed at an angle to score lines 48 and 50. Instead of having apertures 90 and 94 that are generally elongated in form, the perforations 44 and 46 may have circular shaped apertures 90 and 94 in other embodiments. Again, it is to be understood that the perforations 44 and 46 may be of any size or shape and that the apertures 90 and 94 may be of any depth in accordance with various exemplary embodiments.

Figure 4:
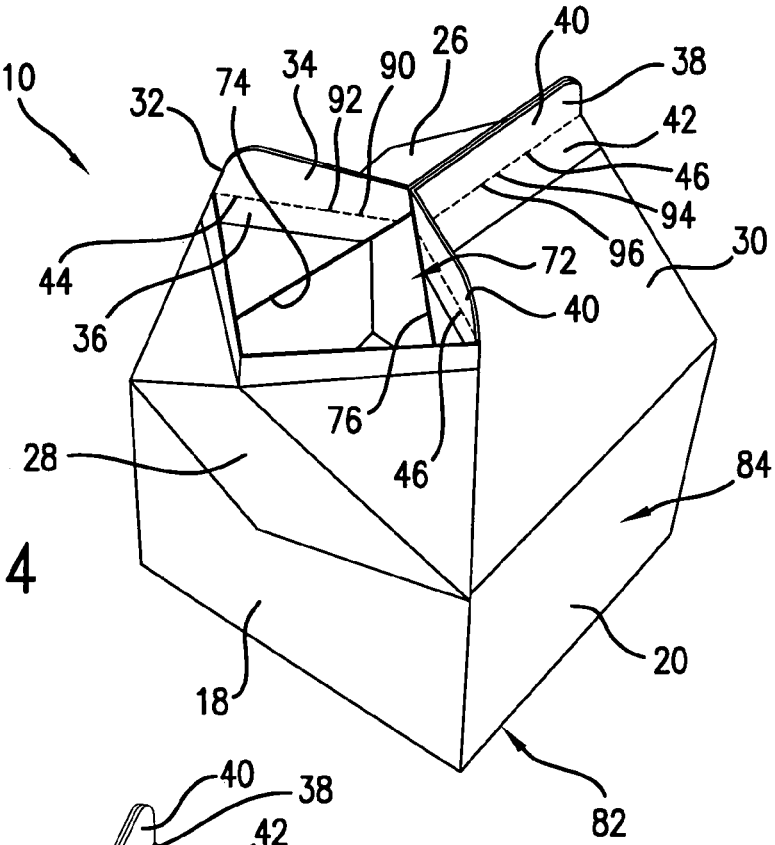
FIG. 4 is a perspective view of the gable top container formed by the blank of FIG. 1 in an open position in which a spout is formed.

The gable top container 10 may also be configured to open so as to form a conventional spout 72 as shown in FIG. 4. A user may first pull apart the connection of fins 32 and 38 so they separate from one another from their ends to a location proximate to their midpoints. The remaining length of fins 32 and 38 stay connected. Next, a user can pull outward an inverted V portion of gusset panel 28 to form a pair of wings made up of gusset panel 28 and gable panels 26 and 30. In this instance, the wings bend outward along score line 74 of gable panel 26 and along score line 76 of gable panel 30. The wings can be pushed inward in order to form a spout 72 from which product in the container 10 may be dispensed or accessed. In the formation of spout 72, the perforations 44 and 46 need not be torn or otherwise broken so that the upper portion 34 of fin 32 remains connected to lower portion 36 and so that upper portion 40 of fin 38 remains connected to lower portion 42.

Figure 5:
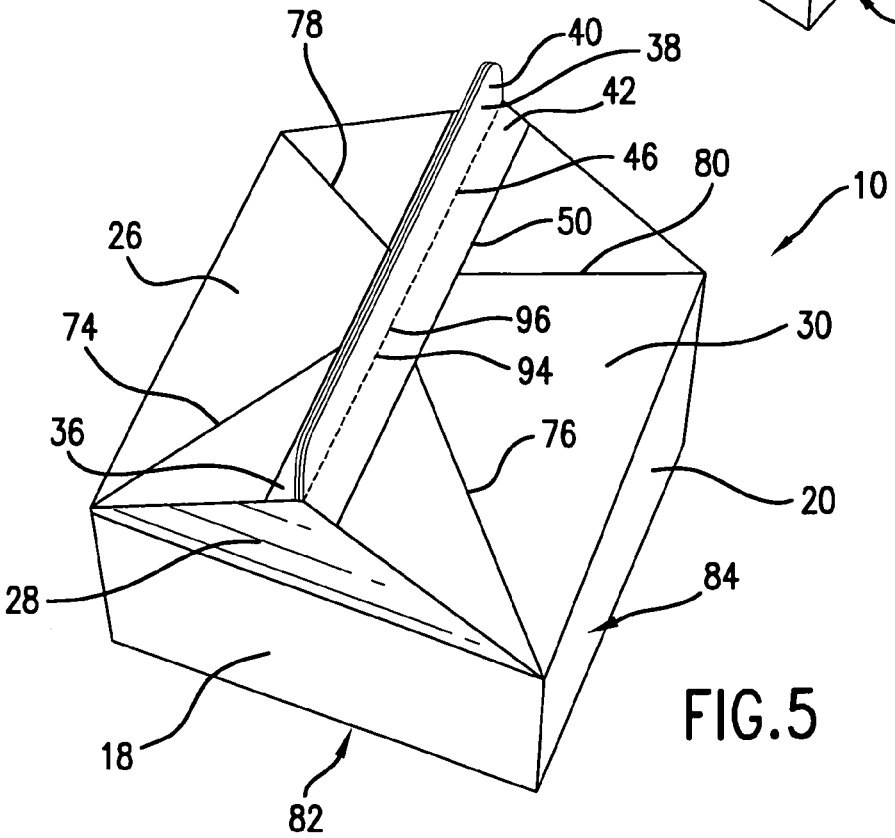
FIG. 5 is a perspective view of a gable top container in the closed position in accordance with one exemplary embodiment of the present invention.

FIG. 5 shows an alternative exemplary embodiment of the gable top container 10 in which additional score lines 78 and 80 have been added to gable panels 26 and 30. The additional score lines 78 and 80 allow for an additional spout to be formed opposite spout 72 as shown in FIG. 4. It may be the case that a user seeks to form a spout by opening the gable top of container 10 on a side opposite the one configured for forming the spout. In such an instance the user may tear the paperboard forming the container 10 and either damage the container 10 or create an improperly formed spout. The presence of additional score lines 78 and 80 allows the user to open container 10 to form a spout on either side of the gable top without improperly tearing the paperboard forming the container 10.

Figure 6:
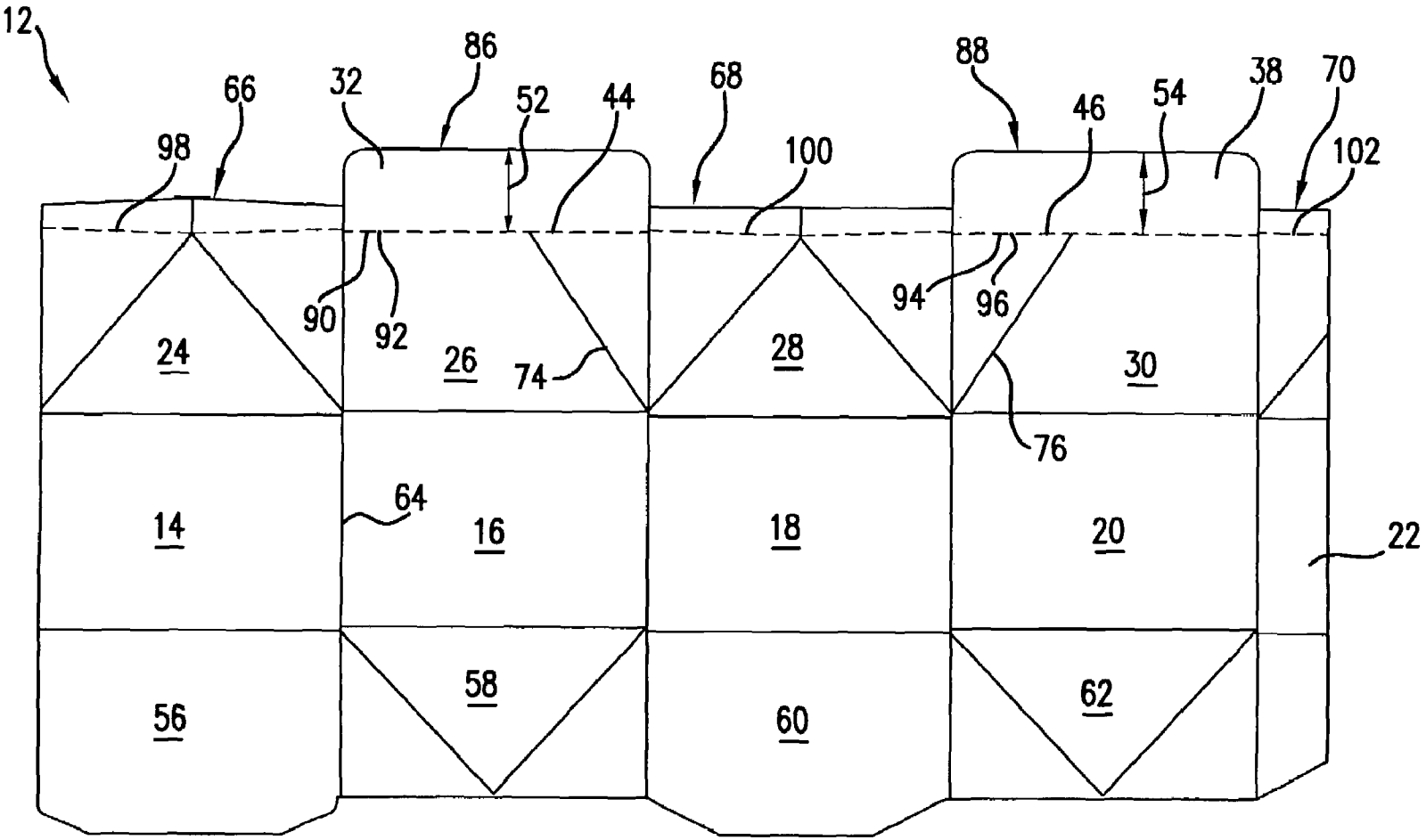
FIG. 6 is a plan view of a unitary blank that is used to form a gable top container in accordance with an alternative exemplary embodiment of the present invention.

FIG. 6 is an alternative exemplary embodiment of the gable top container 10. Here, the perforations 44 and 46 of gable panels 26 and 30 have been relocated from their position in the embodiment of FIG. 1. In FIG. 6, perforations 44 are provided at the same location as score line 48 in FIG. 1. Likewise, perforations 46 are present at the location of score line 50 in FIG. 1. Fin 32 extends from perforations 44 to edge 86, and fin 38 extends from perforations 46 to edge 88. Additionally, score lines present on gusset panels 24 and 28 and on side seam 22 have been replaced with perforations. Specifically, perforations 98 are present on gusset panel 24, and perforations 100 are present on gusset panel 28. Perforations 102 are present on side seam 22. Perforations 98, 44, 100, 46 and 102 are arranged essentially in line with one another. Apertures of the perforations 98, 44, 100, 46 and 102 may be cut completely through the paperboard or may be cut through 75% of the paperboard of blank 12. As with the embodiment shown in FIG. 6 and as with all other embodiments, the perforations and apertures may be of any length and be of any ratio. The specific lengths and ratios shown and described herein are for sake of example. Further, the apertures may extend through 100% of the blank 12 or may extend through some lesser amount.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A gable top container, comprising:

a bottom made from at least one bottom forming panel;

a side made from at least one side forming panel that extends from said bottom;

a first gusset panel and a second gusset panel that make up a pair of gusset panels extending from said side; and a first gable panel and a second gable panel that make up a pair of gable panels extending from said side and arranged with respect to said gusset panels to form a gable top, wherein each of said gable panels has a fin that defines perforations that allow for the removal of at least a portion of said fin in order to effect opening of the container from one end of said gable panels to an opposite end of said gable panels, wherein when said gable panels are arranged in said gable top said perforations on said fin of said first gable panel contact said perforations on said fin of said second gable panel;

wherein when said perforations are torn to cause said end of the container to be placed into an opened position torn perforations are present on the entire upper edges of said first gable panel and said second gable panel and torn perforations are not present on upper edges of said first gusset panel and said second gusset panel.

2. The gable top container as in claim 1, wherein said perforations of said fins are located between an upper portion of said fins and a lower portion of said fins, and wherein said upper portion of said fins is configured to be removed in order to effect opening of the container.

3. The gable top container as in claim 2, wherein said lower portions of said fins are defined by said perforations of said fins and score lines of said gable panels, and wherein said perforations are arranged in a parallel configuration to said score lines of said gable panels.

4. The gable top container as in claim 2, wherein said upper portions of said fins are adhered to one another, and wherein said lower portions of said fins are not adhered to one another.

5. The gable top container as in claim 1, wherein said perforations have a plurality of tabs and apertures that are of the same length.

6. The gable top container as in claim 1, wherein said perforations have a plurality of tabs and apertures in which the length of said apertures is twice the length of said tabs.

7. The gable top container as in claim 1, wherein said perforations have a plurality of tabs and apertures in which the length of said tabs is twice the length of said apertures.

8. The gable top container as in claim 1, wherein said gable panels have a score line from which said fins extend, wherein each of said fins has an edge that is located at a top of said gable top, and wherein said perforations are located less than the midpoint of the distance from said score lines to said edges of said fins that are located at said top of said gable top.

9. The gable top container as in claim 1, wherein said gable panels and said first gusset panel are configured for being opened to form a spout.

10. The gable top container as in claim 9, wherein said gable panels and said second gusset panel are configured for being opened to form a spout.

11. The gable top container as in claim 1, wherein said perforations of said fins are located at the lower edge of said fins.

12. A gable top container, comprising:

a bottom formed by first, second, third and fourth bottom forming panels;

a side formed by first, second, third and fourth side forming panels extending from said bottom;

a side seam extending from said fourth bottom forming panel and said fourth side forming panel, wherein said side seam is attached to said first side forming panel and said first bottom forming panel;

a first gusset panel and a second gusset panel that make up a pair of gusset panels extending from said side; and a first gable panel and a second gable panel that make up a pair of gable panels extending from said side and arranged with respect to said gusset panels to form a gable top, wherein each of said gable panels define perforations that allow for the removal of at least a portion of said gable panels in order to effect opening of the container such that said gable panels separate from one another along the length of said gable panels in order to cause an end of the container to be opened, wherein said first gable panel has an edge that is at a top edge of said gable top and has a flat vertical surface that extends from said perforations of said first gable panel to said edge that is at said top edge of said gable top before said perforations are broken, wherein said second gable panel has an edge that is at said top edge of said gable top and has a flat vertical surface that extends from said perforations of said second gable panel to said edge that is at said top edge of said gable top before said perforations are broken, wherein when in the gable top formation before said perforations are broken said edges of said first and second gable panels are located at an uppermost point of the container at the same location of the height of the container, and wherein when in the gable top formation before said perforations are broken said edges of said first and second gable panels are both free edges, and wherein when in the gable top formation before said perforations are broken said first gable panel and said second gable panel do not overlap one another and engage one another on no more than only one side of both said first gable panel and said second gable panel at all locations of said first gable panel and said second gable panel above said perforations of said first gable panel and said second gable panel.

13. The gable top container as in claim 12, wherein each of said gable panels has a fin that extends from a score line of said gable panel to said edge of said gable panel, and wherein said perforations are defined by said fins of said gable panels.

14. The gable top container as in claim 13, wherein said perforations are located less than the midpoint of the distance from said score lines to said edges of said gable panels.

15. The gable top container as in claim 13, wherein upper portions of said fins are configured to be removed in order to effect opening of the container such that said gable panels separate from one another along their length.

16. The gable top container as in claim 13, wherein said perforations are arranged in a parallel configuration to said score lines of said gable panels.

17. The gable top container as in claim 12, wherein said bottom defines a perimeter, and wherein said gusset panels and said gable panels are configured to open such that the edges of said gusset panels and the tops of said gable panels define a perimeter of the same size as said perimeter of said bottom, wherein when said perforations are torn to cause said end of the container to be placed into an opened position torn perforations are present on an entire upper edge of said first gable panel and on an entire upper edge of said second gable panel and torn perforations are not present on upper edges of said first gusset panel and said second gusset panel.

18. The gable top container as in claim 12, wherein said perforations have a plurality of tabs and apertures that are of the same length.

19. The gable top container as in claim 12, wherein said perforations have a plurality of tabs and apertures in which the length of said apertures is twice the length of said tabs.

20. The gable top container as in claim 12, wherein said gable panels and said first gusset panel are configured for being opened to form a spout.

21. The gable top container as in claim 20, wherein said gable panels and said second gusset panel are configured for being opened to form a spout.

22. The gable top container as in claim 12, wherein each of said gable panels has a fin that extends from said perforations of said gable panels to said top edge of said gable top.

23. A gable top container, comprising:

a bottom formed by first, second, third and fourth bottom forming panels;

a side formed by first, second, third and fourth side forming panels extending from said bottom;

a side seam extending from said fourth side forming panel, wherein said side seam is attached to said first side forming panel;

a pair of gusset panels extending from said side; and a first gable panel and a second gable panel that make up a pair of gable panels extending from said side and arranged with respect to said gusset panels to form a gable top, wherein said gable panels have fins that extend from score lines of said gable panels to edges of said gable panels, wherein upper portions of said fins are adhered to one another, and wherein said fins define perforations parallel to said score lines that allow for the removal of said upper portions of said fins in order to effect opening of the container such that said gable panels separate from one another along the length of said gable panels in order to cause an end of the container to be opened, wherein when said gable panels are arranged in said gable top said perforations on said fin of said first gable panel contact said perforations on said fin of said second gable panel;

wherein when said perforations are torn to cause said end of the container to be placed into an opened position torn perforations are present on the entire upper edges of said first gable panel and said second gable panel and torn perforations are not present on upper edges of said first gusset panel and said second gusset panel.

* * * * *